US005229762A

United States Patent [19]

Itoh et al.

[11] Patent Number: 5,229,762

[45] Date of Patent: Jul. 20, 1993

[54] GRADATION CONVERSION SYSTEM FOR CONVERTING COLOR DISPLAY DATA INTO GRADATION DISPLAY DATA

[75] Inventors: Hiromichi Itoh, Yokohama; Yoshihiro Hayashi, Narashino; Masami Yamagishi, Yokohama; Masayuki Nagaoka, Yokohama; Shigenobu Ishimoto, Yokohama; Susumu Onodera, Yokohama, all of Japan

[73] Assignees: Hitachi, Ltd., Tokyo; Hitachi Video and Information System, Inc., Kanagawa, both of Japan

[21] Appl. No.: 732,238

[22] Filed: Jul. 18, 1991

[30] Foreign Application Priority Data

Jul. 18, 1990 [JP] Japan ..... 2-190331

[51] Int. Cl.[5] ..... G09G 3/00

[52] U.S. Cl. ..... 340/793; 340/703

[58] Field of Search ..... 340/703, 721, 723, 799, 340/798, 793, 701

[56] References Cited

U.S. PATENT DOCUMENTS

| | | | |
|---|---|---|---|
| 4,368,461 | 1/1983 | Komatsu et al. | 340/703 |
| 4,639,721 | 1/1987 | Eto et al. | 340/721 |
| 4,808,989 | 2/1989 | Tabata et al. | 340/703 |
| 4,818,979 | 4/1989 | Manson | 340/723 |
| 5,028,917 | 7/1991 | Imanishi et al. | 340/721 |
| 5,091,717 | 1/1992 | Carrie et al. | 340/703 |

FOREIGN PATENT DOCUMENTS

| | | |
|---|---|---|
| 63-202795 | 8/1988 | Japan . |
| 1105295 | 4/1989 | Japan . |
| 1118191 | 5/1989 | Japan . |

*Primary Examiner*—Alvin E. Oberley
*Assistant Examiner*—Chanh Nguyen
*Attorney, Agent, or Firm*—Antonelli, Terry, Stout & Kraus

[57] ABSTRACT

A gradation conversion system comprising: a plurality of gradation conversion devices for converting color display data into gradation display data by different gradation conversion methods, respectively; and switching device for selectively activating one of the plurality of graduation conversion device. Accordingly, if a number of different colors are to be displayed in the same number of gradations when converting multi-color display data into gradation display data, it is possible to perform this gradation conversion. On the other hand, if different colors are to be displayed in gradations as exact to the brightnesses of colors as possible, it is possible to select one of plural gradation conversion methods so as to carry out this gradation conversion.

11 Claims, 13 Drawing Sheets

FIG. 3

| ADDER 19b OUTPUT | | | | | GRADATION DATA 11a |
|---|---|---|---|---|---|
| $Y2^4$ | $Y2^3$ | $Y2^2$ | $Y2^1$ | $Y2^0$ | |
| 0 | 0 | 0 | 0 | 0 | 0 |
| 0 | 0 | 0 | 0 | 1 | 1 |
| 0 | 0 | 0 | 1 | 0 | 1 |
| 0 | 0 | 0 | 1 | 1 | 2 |
| 0 | 0 | 1 | 0 | 0 | 2 |
| 0 | 0 | 1 | 0 | 1 | 3 |
| 0 | 0 | 1 | 1 | 0 | 4 |
| 0 | 0 | 1 | 1 | 1 | 4 |
| 0 | 1 | 0 | 0 | 0 | 5 |
| 0 | 1 | 0 | 0 | 1 | 5 |
| 0 | 1 | 0 | 1 | 0 | 6 |
| 0 | 1 | 0 | 1 | 1 | 7 |
| 0 | 1 | 1 | 0 | 0 | 7 |
| 0 | 1 | 1 | 0 | 1 | 8 |
| 0 | 1 | 1 | 1 | 0 | 8 |
| 0 | 1 | 1 | 1 | 1 | 9 |
| 1 | 0 | 0 | 0 | 0 | 10 |
| 1 | 0 | 0 | 0 | 1 | 10 |
| 1 | 0 | 0 | 1 | 0 | 11 |
| 1 | 0 | 0 | 1 | 1 | 11 |
| 1 | 0 | 1 | 0 | 0 | 12 |
| 1 | 0 | 1 | 0 | 1 | 13 |
| 1 | 0 | 1 | 1 | 0 | 13 |
| 1 | 0 | 1 | 1 | 1 | 14 |
| 1 | 1 | 0 | 0 | 0 | 14 |
| 1 | 1 | 0 | 0 | 1 | 15 |

FIG. 5

| PHYSICAL COLOR DATA 10 | | | | | | GRADATION DATA 11b | PHYSICAL COLOR DATA 10 | | | | | | GRADATION DATA 11b |
|---|---|---|---|---|---|---|---|---|---|---|---|---|---|
| $R2^5$ | $R2^4$ | $G2^5$ | $G2^4$ | $B2^5$ | $B2^4$ | | $R2^5$ | $R2^4$ | $G2^5$ | $G2^4$ | $B2^5$ | $B2^4$ | |
| 0 | 0 | 0 | 0 | 0 | 0 | 0 | 1 | 0 | 0 | 0 | 0 | 0 | 2 |
| 0 | 0 | 0 | 0 | 0 | 1 | 1 | 1 | 0 | 0 | 0 | 0 | 1 | 2 |
| 0 | 0 | 0 | 0 | 1 | 0 | 1 | 1 | 0 | 0 | 0 | 1 | 0 | 3 |
| 0 | 0 | 0 | 0 | 1 | 1 | 7 | 1 | 0 | 0 | 0 | 1 | 1 | 10 |
| 0 | 0 | 0 | 1 | 0 | 0 | 5 | 1 | 0 | 0 | 1 | 0 | 0 | 6 |
| 0 | 0 | 0 | 1 | 0 | 1 | 8 | 1 | 0 | 0 | 1 | 0 | 1 | 2 |
| 0 | 0 | 0 | 1 | 1 | 0 | 1 | 1 | 0 | 0 | 1 | 1 | 0 | 3 |
| 0 | 0 | 0 | 1 | 1 | 1 | 7 | 1 | 0 | 0 | 1 | 1 | 1 | 10 |
| 0 | 0 | 1 | 0 | 0 | 0 | 5 | 1 | 0 | 1 | 0 | 0 | 0 | 6 |
| 0 | 0 | 1 | 0 | 0 | 1 | 8 | 1 | 0 | 1 | 0 | 0 | 1 | 6 |
| 0 | 0 | 1 | 0 | 1 | 0 | 8 | 1 | 0 | 1 | 0 | 1 | 0 | 11 |
| 0 | 0 | 1 | 0 | 1 | 1 | 13 | 1 | 0 | 1 | 0 | 1 | 1 | 7 |
| 0 | 0 | 1 | 1 | 0 | 0 | 12 | 1 | 0 | 1 | 1 | 0 | 0 | 14 |
| 0 | 0 | 1 | 1 | 0 | 1 | 12 | 1 | 0 | 1 | 1 | 0 | 1 | 12 |
| 0 | 0 | 1 | 1 | 1 | 0 | 13 | 1 | 0 | 1 | 1 | 1 | 0 | 12 |
| 0 | 0 | 1 | 1 | 1 | 1 | 13 | 1 | 0 | 1 | 1 | 1 | 1 | 13 |
| 0 | 1 | 0 | 0 | 0 | 0 | 2 | 1 | 1 | 0 | 0 | 0 | 0 | 9 |
| 0 | 1 | 0 | 0 | 0 | 1 | 3 | 1 | 1 | 0 | 0 | 0 | 1 | 9 |
| 0 | 1 | 0 | 0 | 1 | 0 | 3 | 1 | 1 | 0 | 0 | 1 | 0 | 10 |
| 0 | 1 | 0 | 0 | 1 | 1 | 7 | 1 | 1 | 0 | 0 | 1 | 1 | 10 |
| 0 | 1 | 0 | 1 | 0 | 0 | 6 | 1 | 1 | 0 | 1 | 0 | 0 | 9 |
| 0 | 1 | 0 | 1 | 0 | 1 | 4 | 1 | 1 | 0 | 1 | 0 | 1 | 9 |
| 0 | 1 | 0 | 1 | 1 | 0 | 1 | 1 | 1 | 0 | 1 | 1 | 0 | 9 |
| 0 | 1 | 0 | 1 | 1 | 1 | 7 | 1 | 1 | 0 | 1 | 1 | 1 | 10 |
| 0 | 1 | 1 | 0 | 0 | 0 | 5 | 1 | 1 | 1 | 0 | 0 | 0 | 14 |
| 0 | 1 | 1 | 0 | 0 | 1 | 5 | 1 | 1 | 1 | 0 | 0 | 1 | 14 |
| 0 | 1 | 1 | 0 | 1 | 0 | 8 | 1 | 1 | 1 | 0 | 1 | 0 | 9 |
| 0 | 1 | 1 | 0 | 1 | 1 | 7 | 1 | 1 | 1 | 0 | 1 | 1 | 10 |
| 0 | 1 | 1 | 1 | 0 | 0 | 12 | 1 | 1 | 1 | 1 | 0 | 0 | 14 |
| 0 | 1 | 1 | 1 | 0 | 1 | 12 | 1 | 1 | 1 | 1 | 0 | 1 | 14 |
| 0 | 1 | 1 | 1 | 1 | 0 | 13 | 1 | 1 | 1 | 1 | 1 | 0 | 14 |
| 0 | 1 | 1 | 1 | 1 | 1 | 13 | 1 | 1 | 1 | 1 | 1 | 1 | 15 |

FIG. 13
PRIOR ART

| LOGICAL COLOR | PHYSICAL COLOR (PALLET SET VALUE) | | | COLOR | BRIGHTNESS Y | BRIGHTNESS ORDER | GRADATION VALUE |
|---|---|---|---|---|---|---|---|
| | R | G | B | | | | |
| 0 | 00H | 00H | 00H | BLACK | 0.0 | 0 | 0 |
| 1 | 00H | 00H | 2AH | BLUE | 4.6 | 1 | 1 |
| 2 | 00H | 2AH | 00H | GREEN | 24.8 | 5 | 6 |
| 3 | 00H | 2AH | 2AH | PALE BLUE | 29.4 | 7 | 7 |
| 4 | 2AH | 00H | 00H | RED | 12.6 | 2 | 3 |
| 5 | 2AH | 00H | 2AH | PURPLE | 17.2 | 3 | 4 |
| 6 | 2AH | 2AH | 00H | YELLOW | 37.4 | 9 | 9 |
| 7 | 2AH | 2AH | 2AH | WHITE | 42.0 | 11 | 10 |
| 8 | 15H | 15H | 15H | GRAY | 21.0 | 4 | 5 |
| 9 | 15H | 15H | 3FH | BRIGHT BLUE | 25.6 | 6 | 6 |
| 10 | 15H | 3FH | 15H | BRIGHT GREEN | 45.8 | 12 | 11 |
| 11 | 15H | 3FH | 3FH | BRIGHT PALE BLUE | 50.4 | 13 | 12 |
| 12 | 3FH | 15H | 15H | BRIGHT RED | 33.6 | 8 | 8 |
| 13 | 3FH | 15H | 3FH | BRIGHT PURPLE | 38.2 | 10 | 9 |
| 14 | 3FH | 3FH | 15H | BRIGHT YELLOW | 58.4 | 14 | 14 |
| 15 | 3FH | 3FH | 3FH | BRIGHT WHITE | 63.0 | 15 | 15 |

GRADATION CONVERSION SYSTEM FOR CONVERTING COLOR DISPLAY DATA INTO GRADATION DISPLAY DATA

BACKGROUND OF THE INVENTION 1. Field of the Invention

This invention relates to a gradation conversion system for converting color display data into gradation display data, and more particularly to a gradation conversion system which is suitable for a horizontal display, such as a liquid crystal display or a plasma display, to be used in a personal computer or the like.

2. Description of the Related Art

Generally, in personal computers and workstations, it has been customary to perform color display using a color cathode ray tube (CRT), and many types of application software have been developed on the premise that will be a method of color display.

Meanwhile, accommodating growing needs for the minintuarization of information processing apparatuses, a variety of laptop personal computers are currently being put on the market. In the existing laptop personal computer, to reduce its weight and thickness, a liquid crystal panel or a plasma panel other than the usual color CRT is used as a display. This type of display is hereinafter called a panel display.

As panel displays, some color crystal panels have currently been developed but are still expensive; most of the conventional panel displays are monochromatic. Consequently, when the application software for color display by a color CRT is operated on a laptop personal computer having the panel display, it would make no distinction between colors.

To this end, generally in the panel display, gradation display is performed by varying the lighting time of each individual display dot to represent a difference in color as a difference in gradation. At that time, how to convert color information into gradation information is an important factor in improving display quality.

FIG. 11 of the accompanying drawings is a block diagram showing a typical information processing apparatus incorporated in the conventional gradation conversion method.

In FIG. 11, reference numeral 1 designates a CPU; 2, a CPU bus; 3, a display controller; 5, a display memory for storing the content of display; 7, a pallet circuit for converting logical color data 9 into physical color data 10; 8, a gradation converter circuit for converting the physical color data 10 into gradation data 11; and 12, a panel display.

FIG. 12 is a block diagram showing the display memory 5 and the pallet circuit 7.

In FIG. 12, the pallet circuit 7 is a kind of RAM for storing, as address input, logical color data 9 which is the output data of the display memory 5 and for outputting physical color data 10. The display memory 5 is composed of four planes 0–3 so that logical color data 9 can discriminate at most $2^4=16$ color.

Assuming that 6-bit brightness information for each of the three primary colors RGB (Red, Green, Blue) is stored, the internal RAM of the pallet circuit 7 can output $2^6\times2^6\times2^6=262144$ colors as physical color data 10. At that time, since the logical color data 9 equivalent to the address input of the pallet circuit 7 is 4-bit data and can represent 16 colors, the pallet circuit 7 may be called a circuit for converting 16 colors into 262144 colors or a circuit for displaying just 16 colors from a total of 262144.

Alternatively if the display memory 5 is composed of eight planes so that the logical color data 9 to be given to the pallet circuit 7 is 8-bit data, the pallet circuit 7 can simultaneously display 256 colors from a total of 262144 colors.

The pallet circuit 7 is also called a color look-up table, which is described in detail in Japanese Patent Publication (KOKAI) No. 54-37943.

The gradations that can be displayed on the panel display 12 are at most sixteen; increasing the number of gradations is difficult technologically and makes it difficult for the user to discriminate gradations from one another.

The gradation converter circuit 8 of FIG. 11 creates, from the physical color data 10 of 262144 colors thus obtained, the gradation data 11 representing 16 gradations. This creating is performed generally by converting RGB information into brightness information Y using the following known equation:

$$Y=0.3R+0.59G+0.11B \quad (1)$$

Namely the gradation converter circuit 8 creates data of 16 gradations by dividing the brightness information Y, which is obtained by the equation (1), by a threshold value dividing 0–1 into 16 equal parts.

Thus, in the prior art, the color data to be displayed is converted into gradation data to display a difference in color as a difference in gradation on the panel display 12.

In personal computers and the like, the purposes of color display can be divided chiefly into the following two areas:

The first purpose is to show a distinction between letters or regions by a difference in color. Typical examples of this purpose are to display a text, simple graphics, etc. Generally, in this case, 16 colors as shown in FIG. 13 are used; these 16 colors are hereinafter called 16 basic colors. FIG. 13 shows set values of the pallet circuit 7, and brightness and gradation values calculated using the equation (1).

The second purpose is to express the colors themselves. Typical examples of this purpose are to display a natural image, high resolution computer graphics, etc. Generally, in this case, 256 or more colors are used.

In the first purpose, when performing gradation conversion of color display data into monochromatic data, it is preferable to convert different colors into different gradations rather than to express the brightnesses of colors exactly. However, regarding the gradation values shown in FIG. 13, green and bright blue are equal to each other, and yellow and bright purple are equal to each other. By the converting method using the equation (1), it is impossible to convert the 16 basic colors into sixteen different gradations. Therefore, in the case of the first purpose, it is preferable to associate each of the 16 colors with one of 16 gradations.

In the second purpose, to for obtaining a natural monochromatic image, it is necessary to convert the brightnesses of colors into gradations with fidelity, so it is preferably to perform conversion using the equation (1).

Conventionally, in a personal computer capable of displaying only 16 colors even using a color CRT, since a gradation value is obtained by associating one color with one gradation, the 16 basic colors can be converted into 16 gradations.

However in personal computers capable of displaying 16 or 256 colors of 260,000 colors on a color CRT by using a pallet circuit, it is a common practice to perform the gradation conversion using the equation (1). In such a personal computer, if a text or the like using only 16 basic colors is displayed in graduation on a panel display, displaying in 16 different gradations would be difficult to achieve.

Japanese Patent Laid-Open Publication (KOKAI) No. 1-118191 discloses a system which counts the number of colors used in a single screen and performs gradation conversion into gradation codes of constant space according to the number of colors in use.

According to this prior system, in the case where four colors are in use, for example, the gradation codes of four gradations of constant space are outputted from 16 gradations corresponding to the 16 basic colors, irrespective of their physical color data. Therefore, even though the physical data of four colors are contiguous to one another, it is possible to automatically perform gradation conversion into gradation codes easiest to see.

However, in this prior system, it is impossible to perform gradation conversion with fidelity to the brightness of the colors.

SUMMARY OF THE INVENTION

It is therefore an object of this invention to provide a gradation conversion system capable of switching the gradation conversion method between a first mode of displaying a number of different colors in as many different gradations and a second mode of displaying different colors in gradations as exact to the brightness of the colors as possible.

According to a first aspect of the invention, there is provided a gradation conversion system comprising: a plurality of gradation conversion means for converting color display data into gradation display data by different gradation conversion methods, respectively; and switching means for selectively activating one of the plurality of gradation conversion means.

The system may further comprise means for detecting whether the system is to be operated in a text display mode or a graphics display mode. The switching means is operable to selectively activate one of the gradation conversion means based on the result of detection of the detecting means.

Alternatively, the system may further comprise means for detecting whether the system is to be operated in a first mode capable of simultaneously displaying a predetermined number of colors or a second mode capable of simultaneously displaying more than the predetermined number of colors. The switching means being operable to selectively activate one of the gradation conversion means based on the result of detection of the detecting means.

In an alternative form, the system further comprises means for detecting whether the color display data use colors only in a plurality of predetermined colors or colors other than the predetermined colors. The switching means is operable to selectively activate one of the gradation conversion means based on the result of detection of the detecting means.

In another alternative form, the system further comprises means for physically designating the gradation conversion means to be selectively activated by the switching means. The switching means is operable to selectively activate one of the gradation conversion means according to the designation from the designating means. The designating means can be realized by a switch, a button or a key, for example.

Preferably, the plurality of gradation conversion means may include a first gradation conversion means for performing gradation conversion using a calculating formula, and a second gradation conversion means for performing gradation conversion so as to associate different colors one with each of different tones. Namely, the switching means selects the first gradation conversion means when displaying the color data in gradations exact to the brightness of the colors, and otherwise selects the second gradation conversion means when displaying a number of different colors in as many gradations.

Also, the gradation conversion means may be capable of creating gradation data from physical or logical data.

According to a second aspect of the invention, there is provided an information processing apparatus loaded with an LSI circuit which comprises: a plurality of gradation conversion circuits for converting color display data into gradation display data respectively by different gradation conversion methods; and a selector for selectively activating one of the plurality of gradation conversion circuits. Preferably, the LSI circuit may be loaded into a small computer, such as a laptop computer, a book-type computer or an electronic pocketbook. Of course, the LSI circuit may be adopted to the display of a desktop computer, a medium-sized computer or a larger-sized computer.

In operation, the detecting means monitors the set value of the operating mode setting I/O register of the display controller and detects whether the system is operated in the text mode or the graphics mode.

If it is determined that the system is being operated in the text mode as the result of detection, the switching means selects the gradation conversion means for performing gradation conversion associating different colors one with each of a number of different gradations. This selected gradation conversion means then performs the conversion, for example, such that the 16 basic colors are associated one with each of 16 different gradations.

On the other hand, if it is determined that the system is being operated in the graphics mode, the switching means selects the gradation conversion means for performing gradation conversion using a calculating formula. This selected gradation conversion means then performs such conversion using the previously mentioned equation (1), for example.

Thus, in the text mode, it is possible to convert a number of different colors into as many different gradations. In the graphics mode, it is possible to convert different colors into gradations exact with the brightness of the colors.

Further, the detecting means detects whether the system is to be in the first mode capable of simultaneously displaying a predetermined number of colors or the second mode capable of simultaneously displaying more than the predetermined number of colors. For example, the detecting means monitors the set value of the operating mode setting I/O register of the display controller and, at the same time, detects the number of colors that can be displayed.

If it is determined that the system is being operated in the first mode as the result of detection, the switching means selects the gradation conversion means for performing gradation conversion associating different colors one with each of different gradations. This gradation conversion means then performs such gradation conversion. This conversion means performs the conversion, for example, such that the 16 basic colors are associated one with each of 16 different gradations.

If the system is determined as being operated in the second mode, the switching means selects the gradation conversion means for performing the gradation conversion using the equation (1).

Thus, in the mode capable of simultaneously displaying 16 colors and to be used in displaying a text, simple graphics or the like, which requires no expression of delicate differences in color, it is possible to display differences in color as differences of gradations. In the mode capable of simultaneously displaying multiple colors and to be used in displaying a natural image or the like, it is possible to convert multiple-color data into gradations exact with the brightness of the colors and to display the multiple-color data as a natural monochromatic gradation image.

Since values showing various operating modes concerning display, such as a value showing whether the system is to be operated in the text mode or the graphics mode, by setting I/O register of the display controller, and a value showing whether the system is to be operated in the first mode capable of simultaneously displaying 16 colors or in the second mode capable of simultaneously displaying more than 16 colors, the foregoing two detecting means can utilize these values as the source of discrimination.

The detecting means, for detecting whether the color display data uses only colors from a plurality of predetermined colors, compares the color data, which is to be outputted from the pallet circuit, with the color data of the predetermined colors, and discriminates whether colors other than the predetermined colors are outputted.

If it is determined that only the predetermined colors are outputted, the switching means selects the gradation conversion associating different colors one with each of different gradations. This gradation conversion means performs such conversion. The predetermined colors are 16 basic colors, for example. This conversion means performs the gradation conversion such that the 16 basic colors are associated one with each of 16 different gradations.

If it is determined to use colors other than the predetermined colors, the switching means selects the gradation conversion means for performing gradation conversion using the calculating formula. This gradation conversion means then performs such conversion. The plurality of predetermined colors are 16 basic colors, for example. This conversion means performs the gradation conversion using the equation (1).

Further, if it is a switch, the designating means is capable of switching the gradation conversion means easily by switching on and off, without the medium of software and hence can select the optimum gradation conversion means while displaying for instance images generated by application software.

The plurality of gradation conversion means may create gradation data from physical color data to be outputted from the pallet circuit or otherwise creates gradation data from logical color data to inputted to the pallet circuit. For example if, of the plural gradation conversion means, the method associating each of a number of different colors with each of different gradations cannot create different gradation data from physical color data, which is to be outputted from the pallet circuit, as the different logical color data are converted into similar or approximate physical color data by the pallet circuit, it is possible to display the logical color data, which is to be inputted to the pallet circuit, into different gradations by creating gradation display data from the logical data.

BRIEF DESCRIPTION OF THE DRAWINGS

FIG. 3 is a diagram showing a truth table of a decoder incorporated in the gradation conversion circuit of FIG. 2;

FIG. 5 is a diagram showing a truth table of the gradation conversion circuit of FIG. 4;

FIG. 13 is a diagram showing a table of information concerning 16 basic colors.

DETAILED DESCRIPTION OF THE PREFERRED EMBODIMENTS

Embodiments of this invention will now be described with reference to the accompanying drawings.

Each of the illustrated embodiments is an information processing apparatus, such as a laptop personal computer or a word processor, to which a display for performing a monochromatic display using plural gradations is applied.

Figure 1:
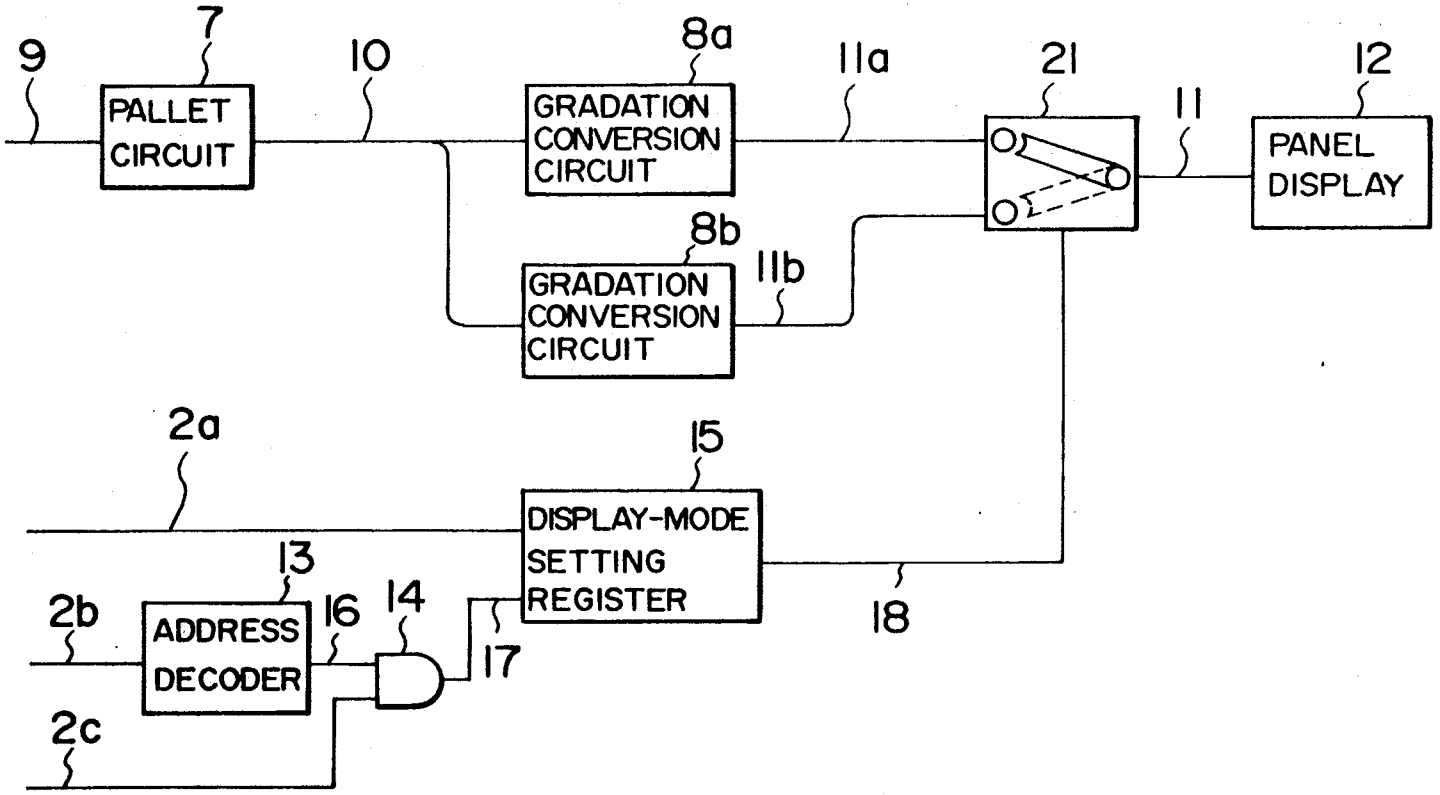
FIG. 1 is a block diagram showing a gradation conversion system according to a first embodiment of this invention.

FIG. 1 shows a gradation conversion system (hereinafter also called "system") according to a first embodiment. In FIG. 1, reference numeral 8*a* designates a first gradation conversion circuit for performing gradation conversion using the equation (1), and 8*b* designates a second gradation conversion circuit equipped with a decoder which is set so as to associate 16 basic colors with 16 different gradations.

21 designates a selector for selecting, based on a gradation-conversion-method selecting signal 18, one of gradation data 11*a* and 11*b* respectively outputted from the first and second gradation conversion circuits 8*a* and 8*b* and for outputting the selected data as gradation data 11.

15 designates a display-mode setting register for setting a value representing a text mode or a graphics mode; and 13, an address decoder for decoding I/O addresses of the display-mode setting register 15.

Figure 11:
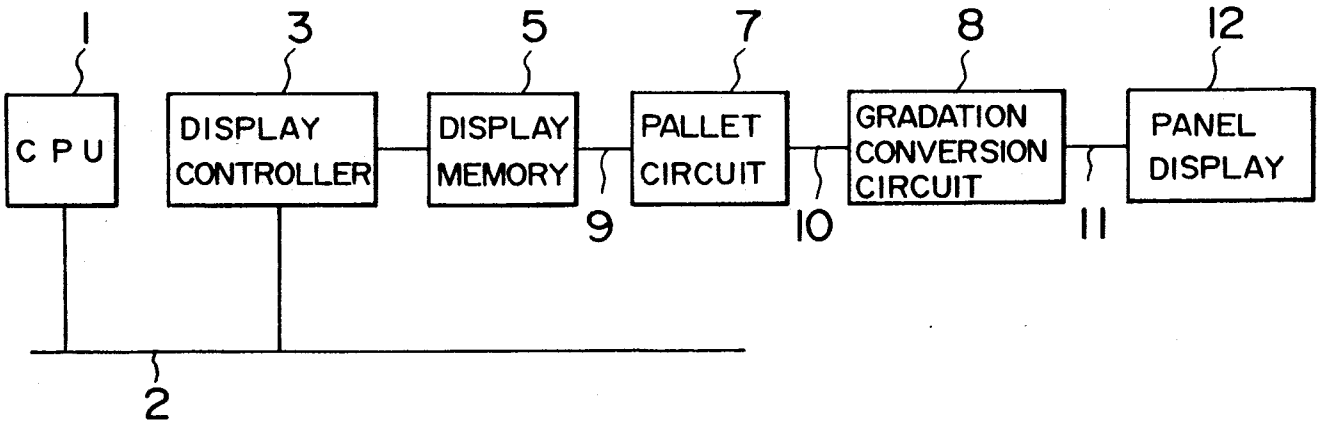
FIG. 11 PRIOR ART
FIG. 11 is a block diagram showing a prior art gradation conversion system.
Figure 12:
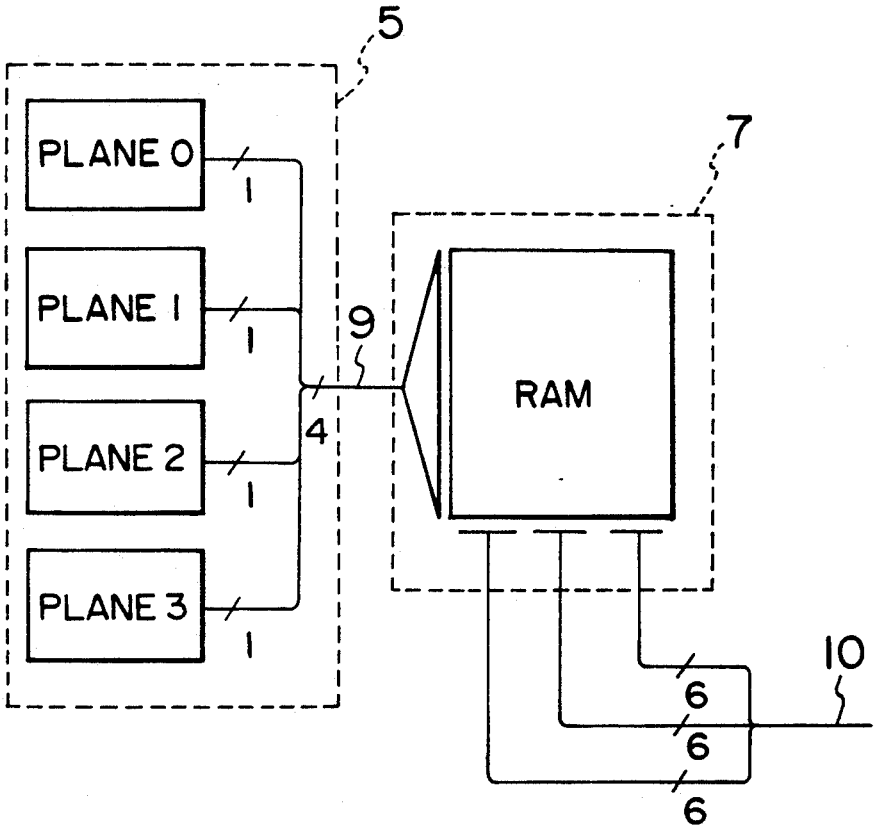
FIG. 12 PRIOR ART
FIG. 12 is a block diagram showing a pallet circuit.

As shown in FIG. 1, the system generally comprises, instead of the gradation conversion circuit 8 of FIG. 11, the two independent gradation circuits 8*a* and 8*b* for performing the two different gradation conversion methods, and the selector 21 disposed between the gradation conversion circuits 8*a*, 8*b* and a panel display 12.

The operation of this system will now be described.

Physical color data 10, in 6 bits for each of RGB (Red, Green and Blue), outputted from a pallet circuit 7, are inputted to the first and second gradation conversion circuits 8*a* and 8*b*. The first gradation conversion circuit 8*a* performs gradation conversion using the equation (1) and outputs 4-bit gradation data 11*a*. Meanwhile, the second gradation conversion 8*b* decodes the physical color data 10 so as to associate each the 16 basic colors with each of 16 different gradations and outputs gradation data 11*b*.

The address decoder 13 decodes a value of an address bus 2*b* of a CPU (not shown) and assumes an address decode output 16 as "H" in the case of addresses of the display-mode setting register 15. An AND gate 14 assumes a display-mode-setting-register write signal 17 as "H" when both the address decode 16 and a write command signal 17 are "H". The display-mode setting register 15 fetches and stores a value of an address bus of the CPU when the display-mode-setting-register write signal 17 is "H". Therefore, the display-mode setting register 15 shows, when its set value is "H", that the system is to be operated in a graphics mode, and shows, when its set value is "L", that the system is to be operated in a text mode. In this embodiment, the set value of the display-mode setting register 15 is outputted as a gradation-conversion-method selecting signal 18 to the selector 21.

The selector 21 selects the gradation data 11*a* when the gradation-conversion-method selecting signal 18 is "H", namely, when the system is to be operated in the graphics mode, and selects the gradation data 11*b* when the gradation-conversion-method selecting signal 18 is "L", namely, when the system is to be operated in the text mode.

Thus, the selector 21 can output, during the graphics mode, the gradation data of the gradation conversion using the equation (1), and can output, during the text mode, the gradation data of the gradation conversion associating each of the 16 basic colors with each of 16 different gradations.

Figure 2:
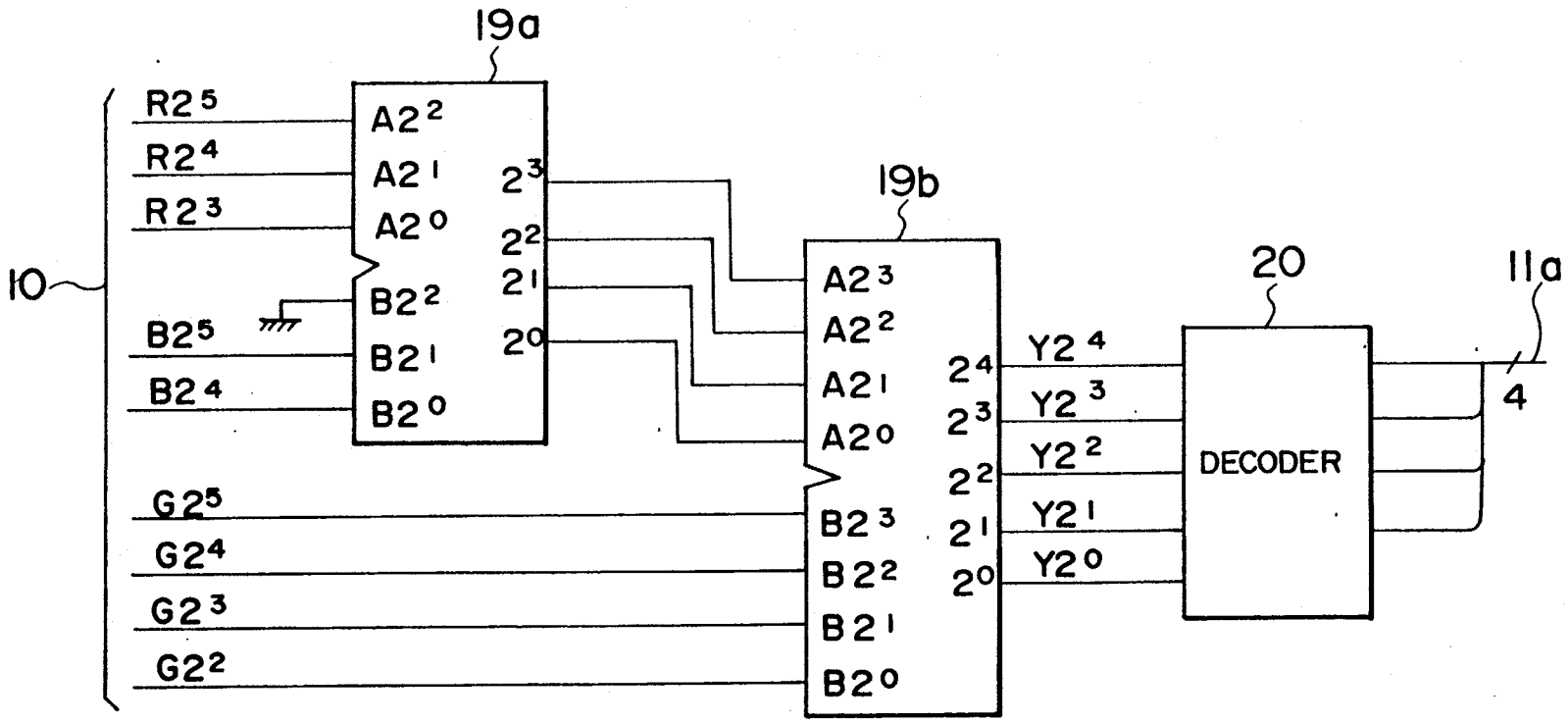
FIG. 2 is a block diagram showing a gradation conversion circuit.

FIG. 2 shows the detailed structure of the gradation conversion circuit 8*a*.

In FIG. 2, reference numerals 19*a* and 19*b* designate adders, and 20 designates a decoder. In this embodiment, for simplification of the circuit, the foregoing equation (1) is approximated as follows:

$$Y=2R+4G+B \tag{2}$$

to realize the gradation conversion circuit 8*a*. Specifically, the gradation conversion circuit 8*a* performs the following calculation:

$$\begin{array}{r} R2^5R2^4R2^3 \\ G2^5G2^4G2^3G2^2 \\ +\quad B2^5B2^4 \\ \hline Y2^4Y2^3Y2^2Y2^1Y2^0 \end{array}$$

The adder 19*a* adds $R2^3$–$R2^5$, $B2^4$ and $B2^5$ and outputs the result of 4 bits. The adder 19*b* adds the output of the adder 19*a* and $G2^2$–$G2^5$ and outputs the result of 5 bits $Y2^0$–$Y2^4$. This result $Y2^0$–$Y2^4$ has a decimal value between 0–25. The decoder 20 decodes $Y2^0$–$Y2^4$ in the manner shown in FIG. 3 and outputs the 4-bit gradation data 11*a*.

Figure 4:
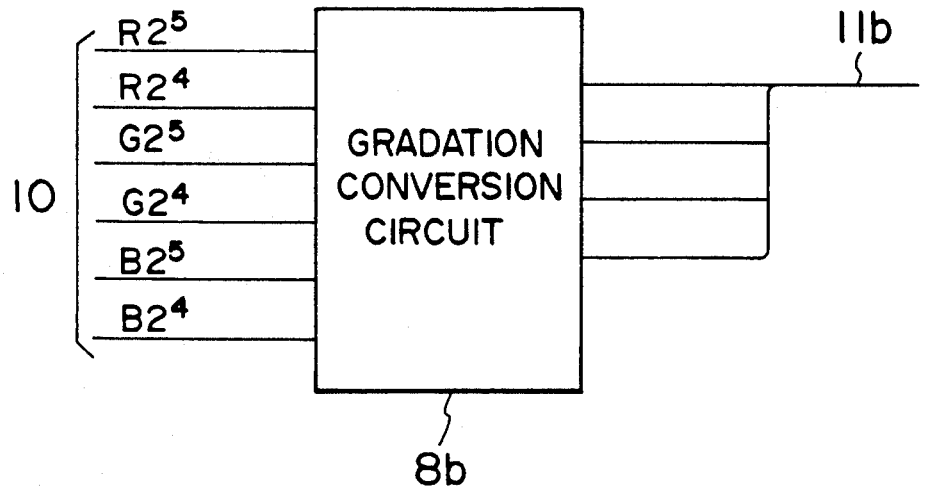
FIG. 4 is a block diagram showing another gradation conversion circuit.

FIG. 4 shows the detailed structure of the second gradation conversion circuit 8*b*.

The second gradation conversion circuit 8*b* inputs the upper 2 bits for each of RGB of the physical color data 10. This gradation conversion circuit 8*b* decodes the inputted upper 2 bits for each of GRB in the manner shown in FIG. 5 and outputs the 4-bit gradation data 11*b*.

In this embodiment, the set value of the display-mode setting register 15 is a set value showing whether the system is to be operated in the text mode or the graphics mode, and this set value is used as the gradation-conversion-method selecting signal 18. Alternatively, the set value may be a set value showing whether the system is to be operated in a first mode capable of simultaneously displaying 16 colors or a second mode capable of simultaneously displaying more than 16 colors, and this set value may be used as the gradation-conversion-method selecting signal 18.

Further, in this embodiment, the system additionally has the display-mode setting register 15. Alternatively, a similar register originally existing within the display controller 3 may be used.

Figure 6:
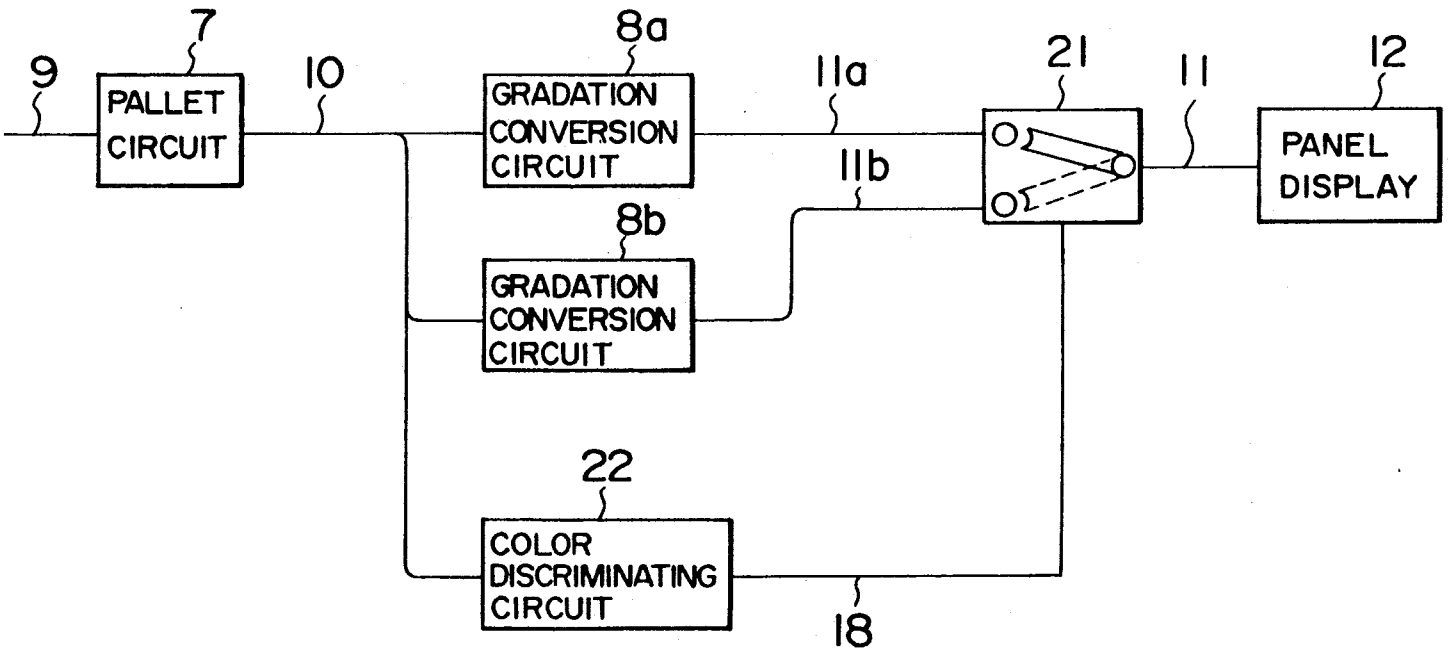
FIG. 6 is a block diagram showing a modified gradation conversion system according to a second embodiment.

FIG. 6 shows a modified gradation conversion system according to a second embodiment.

This embodiment is substantially similar to the first embodiment except that the portion for outputting the gradation-conversion-method selecting signal 18 is different from that of the first embodiment.

For a feature of this embodiment, the system is equipped with a color discriminating circuit 22. The first and second gradation conversion circuits 8*a*, 8*b* and the selector 21 are totally identical to those of the first embodiment.

The operation of this system according to this embodiment will now be described.

The color discriminating circuit 22 discriminates whether or not all physical color data 10 successively outputted in association with each dot on the display screen represent colors within the 16 basic colors. If it is determined that all of the represented colors are within the 16 basic colors, the color discriminating circuit 22 outputs "L" as the gradation-conversion-method selecting signal 18. If otherwise, the color discriminating circuit 22 outputs "H" as the gradation-conversion-method selecting signal 18.

The selector 21 selects the gradation data 11*a* when the gradation-conversion-method selecting signal 18 is "H", and selects the gradation data 11*b* when the gradation-conversion-method selecting signal 18.

Thus, when the output of the physical color data 10 are only colors within the 16 basic colors, the system can output the gradation data as the result of gradation conversion so as to associate the 16 different gradations. And when the output of the physical color data 10 includes colors other than the 16 basic colors, the system outputs the gradation data as the result of gradation conversion using the equation (2).

Figure 7:
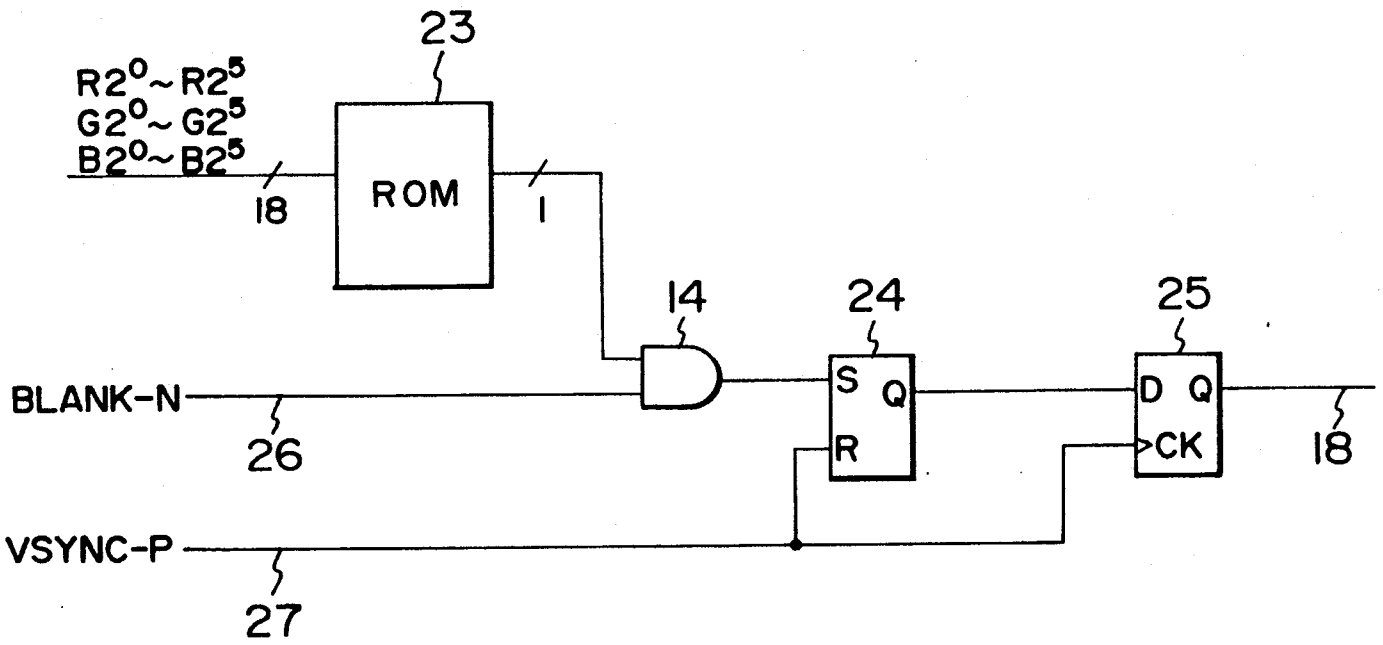
FIG. 7 is a block diagram showing a color discriminating circuit.

FIG. 7 shows the detailed structure of the color discriminating circuit 22.

In FIG. 7, reference numeral 23 designates a ROM; 24, a set-reset FF (flip-flop); and 25, a D-type FF.

The ROM 23 receives, as address input, the physical color data 10 of 18 bits in total, i.e. 6 bits for each of RGB, and outputs "L" in response to the RGB input corresponding to the 16 basic colors, and outputs "H" in response to the RGB input not corresponding to the 16 basic colors.

A BLANK-N signal 26 is a signal which is to be "H" while the effective physical color data 10 is input to the ROM. When the output of the ROM 23 is"H" and when the BLANK-N signal 26 is "H", the AND gate 14 sets the set-reset FF 24. AVSYNC-P signal 27 is a signal for outputting an "H" pulse every time the physical color data 10 has been input for one screen. The set-reset FF 24 is reset every time the VSYNC-P signal 27 becomes "H". Namely, the set-reset FF 24 is set when the physical color data 10 is any other than the 16 basic colors, and is reset every time the output of physical color data 10 for one screen is terminated.

The D-type FF 25 latches the output of the set-reset FF 24 upon termination of the physical data 10 for one screen. Therefore, by using the output of the D-type FF 25, it is possible to obtain a gradation-conversion-method selecting signal 18 which is "L" when all of the physical color data 10 for one screen are composed of the colors in the 16 basic colors and is "H" when otherwise.

In this embodiment, the ROM 23 is used for discriminating whether the physical color data 10 is composed of colors from the 16 basic colors. Alternatively, the ROM 23 may be replaced with 16 comparators for respectively comparing the physical color data with the 16 basic colors, and a circuit for carrying out the logical OR between the outputs of these comparators.

Figure 8:
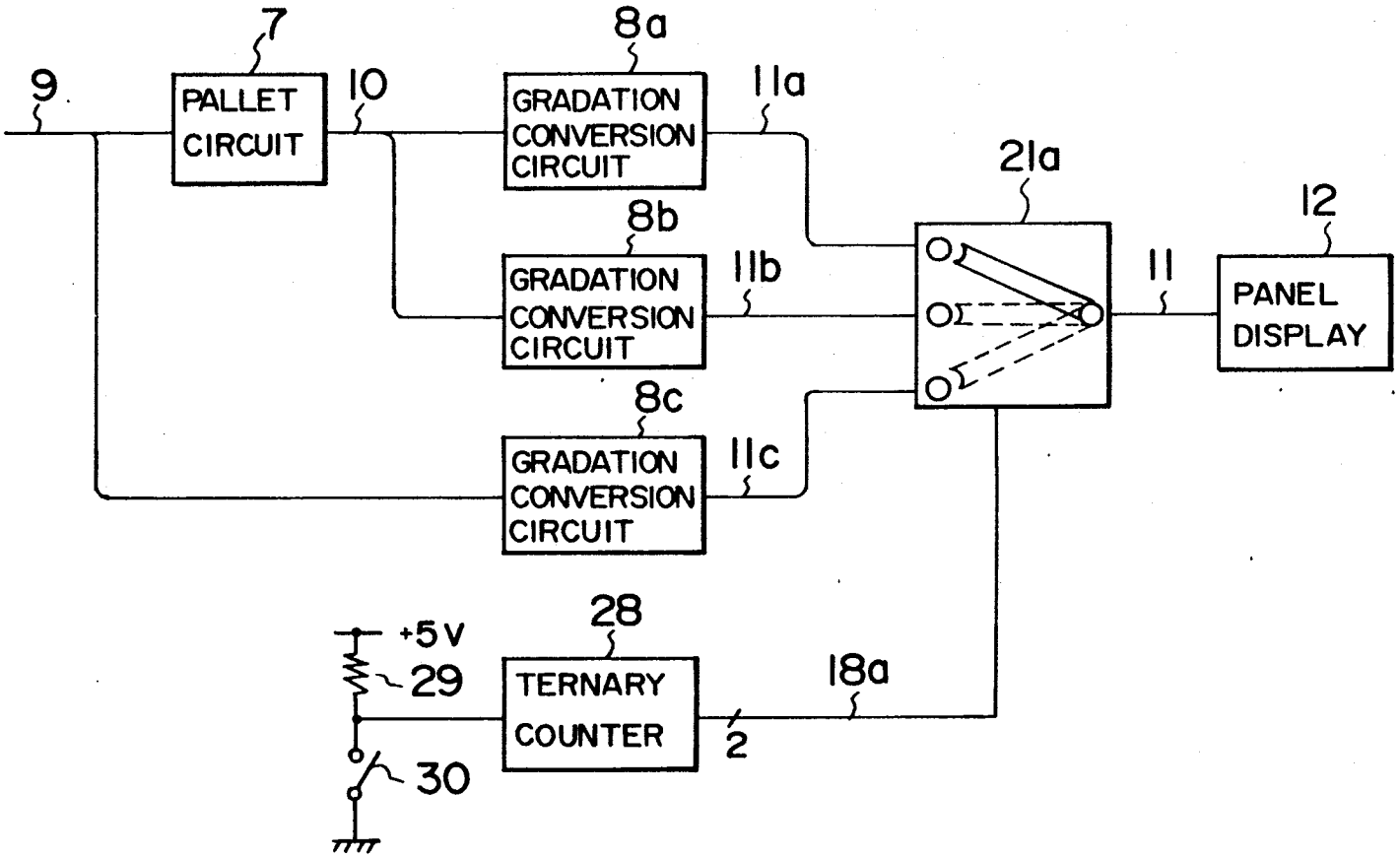
FIG. 8 is a block diagram showing another modified gradation conversion system according to a third embodiment.

FIG. 8 shows another modified gradation conversion system according to a third embodiment.

For a feature of this embodiment, the system is equipped with a third gradation conversion circuit 8*c* for performing the gradation conversion from the logical color data 9 and for producing a gradation-conversion-method selecting signal 18*a* by a switch 30. The first and second gradation conversion circuits 8*a* and 8*b* are identical with those of the first and second embodiments.

The operation of the system according to the third embodiment will now be described.

The third gradation conversion circuit 8*c* creates 4-bit gradation data 11*c* from the 4-bet logical color data 9. At that time, the logical color data 9 may be converted directly into the gradation data 11*c* or may be processed, such as by inverting, before converting.

To the clock input terminal of a ternary counter 28, a resistor 29 and the switch 30 are connected. The resistor 29 is connected at the other end to +5 V, and the switch 30 is connected at the other end to the ground (0 V). Therefore, the ternary counter 28 counts up every time the switch 30 is turned on and off so that a gradation-conversion-method selecting signal 18*a* to be outputted from the ternary counter 28 varies as follows: (L, L), (L, H), (H, L), (L, L), . . . .

The selector 21*a* selects the gradation data 11*a* when the gradation-conversion-method selecting signal 18*a* is (L, L), and selects the gradation data 11*b* when it is (L, H), and selects the gradation data 11*c* when it is (H, L).

As mentioned above, it is possible to physically select the gradation conversion method by turning the switch 30 on and off.

Figure 9:
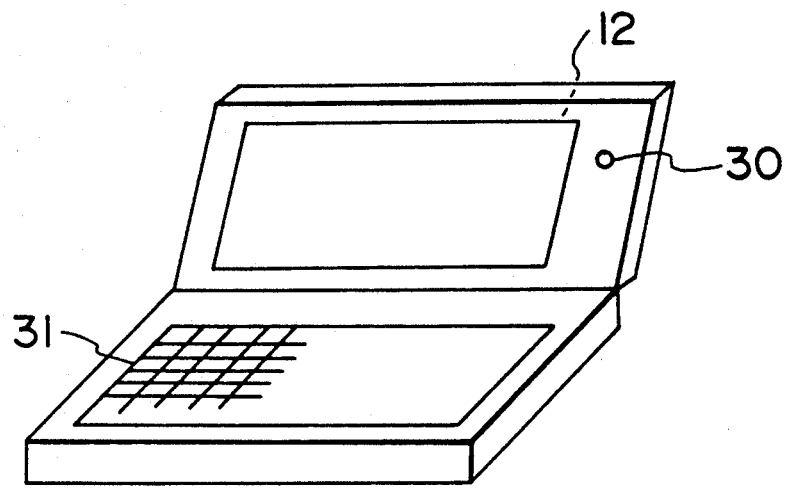
FIGS. 9 and 10 are perspective views respectively showing laptop personal computers each having a switch.
Figure 10:
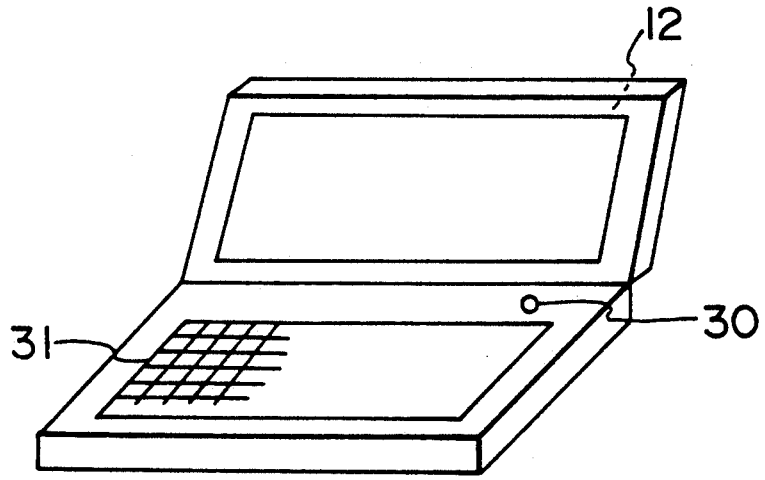

FIGS. 9 and 10 show laptop personal computers each having the switch 30.

In FIGS. 9 and 10, reference numeral 12 designates a panel display, and 31 designates a keyboard.

In this embodiment, a lamp or the like may be used to indicate which one of gradation conversion methods is to be used.

Further, the number of bits of each of the logical color data 9, the physical color data 10 and the gradation data 11 should by no means be limited to the specific number in this embodiment.

In this embodiment, the gradation data is displayed on the panel display 12. This invention may be applied to a printer when making a hard copy.

In addition, one of the gradation conversion circuits may be a gradation conversion circuit which counts the number of colors to be used and converts the color data into gradation codes of constant distances; this gradation conversion circuit may be selected when the number of colors to be used is small.

When different colors should be converted as many different gradations, it is possible to convert the colors into clear gradations, depending on the number of colors to be used.

According to this embodiment, it is possible to realize a gradation conversion LSI circuit equipped with at least gradation conversion circuits and a selector.

For example, both the gradation conversion circuits 8*a*, 8*b* and the selector 21 of FIG. 1 integrated in the form of a single gradation conversion LSI circuit may be loaded onto an information processing apparatus. In an alternative form, a single gradation conversion LSI circuit, in which the gradation conversion circuits 8*a*, 8*b* and the selector 21 are integrated, may be added to an LDI circuit including a pallet circuit, and the resulting circuit may be loaded onto an information processing apparatus. In another alternative form, the gradation conversion LSI circuit may be added to an LSI circuit including a display controller, and the resulting circuit may be loaded onto an information processing apparatus.

Figure 14:
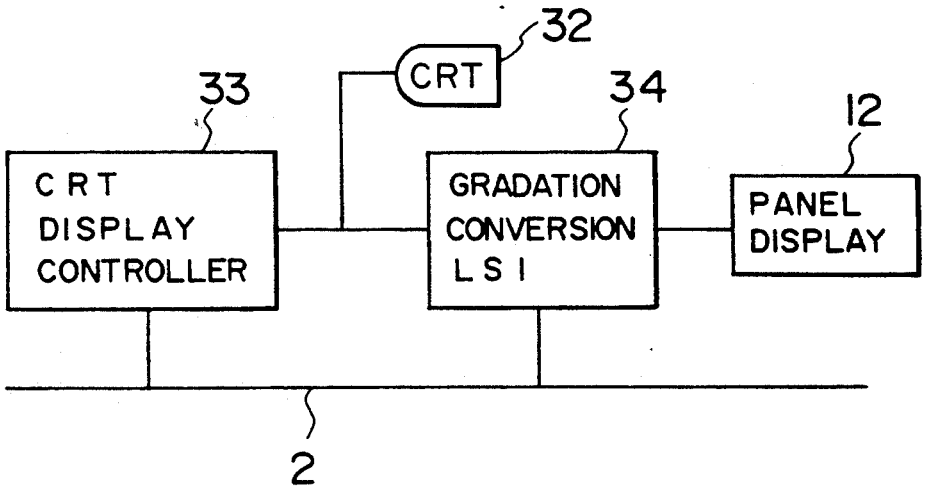
FIGS. 14 and 15 are block diagrams each showing an information processing apparatus onto which a gradation conversion circuit LSI of the invention has been loaded.
Figure 15:
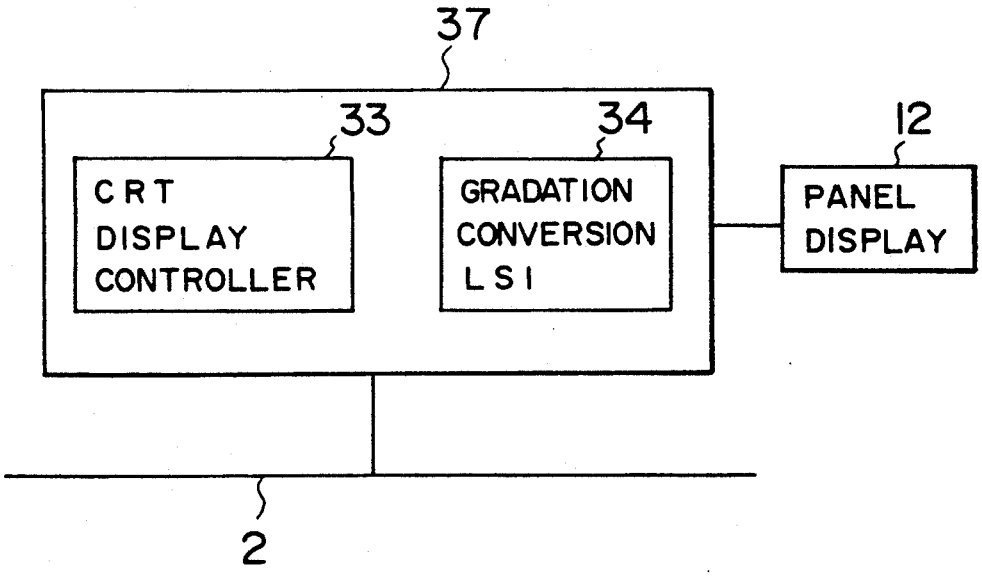

FIGS. 14 and 15 show the first and the third, respectively, of these three examples.

In FIG. 14, reference numeral 34 designates the first-named gradation conversion LSI circuit; and 33, a CRT display controller in the form of an LSI circuit including a display controller and a pallet circuit. With this arrangement, it is possible to convert color display data, for a CRT 32, which is to be outputted from the CRT display controller 33, into gradations by the gradation conversion LSI circuit 34 and to display the gradation data on the panel display 12.

In the example shown in FIG. 15, the third-named gradation conversion LSI circuit is loaded onto an information processing apparatus; the gradation conversion LSI circuit 34 and the CRT display controller 33 of FIG. 14 are combined into a single gradation conversion LSI circuit 37.

In this embodiment, since the circuit components are integrated as an LSI circuit, the system can be loaded, without difficulty, on a small-sized information processing apparatus such as a laptop personal computer, a book-type personal computer or an electronic pocketbook.

As described above, according to this invention, if different colors are to be displayed in as many gradations when converting multi-color display data into gradation display data, it is possible to perform this gradation conversion. Otherwise if different colors are to be displayed in gradations as exact to the brightness of colors as possible, it is possible to select one of plural gradation conversion methods so as to carry out this gradation conversion.

Further, by designating the switching operation physically, it is possible to perform gradation conversion even during execution of the present software, without changing the software.

Therefore, it is possible to display the screen of a variety of color application software on a monochromatic gradation panel display clearly.

What is claimed is:

1. A gradation conversion system for converting color display data into gradation display data to permit display of the color display data as differences in gradation on a display means, such as a monochromatic display device, which is not capable of displaying the color display data as physical colors, wherein the differences in gradation correspond to differences in the color display data, comprising:

(a) first and second gradation conversion means for converting said color display data into gradation display data by different gradation conversion methods, respectively; and (b) switching means for selectively activating one of said first and second gradation conversion means and for coupling the selected gradation conversion means to the display means so that colors in said color display data will be respectively represented on the display means by predetermined gradations in accordance with a first conversion method when the first gradation conversion means is selected, and so that colors in said color display data will be respectively represented on the display means by predetermined gradations in accordance with a second conversion method, different from the first conversion method, when the second gradation conversion means is selected.

2. A gradation conversion system according to claim 1, further comprising means for detecting whether said system is to be operated in a text display mode or a graphics display mode, said switching means being operable to selectively activate one of said gradation conversion means based on the result of detection of said detecting means.

3. A gradation conversion system according to claim 1, further comprising means for detecting whether said system is to be operated in a first mode capable of simultaneously displaying a predetermined number of colors or a second mode capable of simultaneously displaying more than said predetermined number of colors, said switching means being operable to selectively activate one of said gradation conversion means based on the result of detection of said detecting means.

4. A gradation conversion system according to claim 1, further comprising means for detecting whether the color display data use colors only in a plurality of predetermined colors or colors other than said predetermined colors, said switching means being operable to selectively activate one of said gradation conversion means based on the result of detection of said detecting means.

5. A gradation conversion system according to claim 1, further comprising means for physically designating said gradation conversion means to be selectively activated by said switching means, said switching means being operable to selectively activate one of said gradation conversion means according to the designation from said designating means.

6. A gradation conversion system according to claim 1, wherein said plurality of gradation conversion means includes a gradation conversion means for performing gradation conversion using a calculating formula, and a gradation conversion means for performing gradation conversion so as to associate different colors one each with the same number of different tones.

7. A gradation conversion system according to claim 1, wherein said gradation conversion means is capable of creating gradation data from physical or logical color data.

8. A gradation conversion system according to claim 1, wherein the display means comprises a display panel.

9. A gradation conversion system according to claim 8, wherein the display panel comprises a liquid crystal panel.

10. A gradation conversion system according to claim 8, wherein the display panel comprises a plasma panel.

11. A gradation conversion system according to claim 1, wherein the first gradation conversion means comprises means for carrying out a first conversion function for converting a number of different colors into as many different gradations as possible in accordance with a predetermined criteria, and wherein the second gradation conversion means includes means for carrying out a second conversion function for displaying a number of different colors in gradations as exact to the brightness of the colors as possible in accordance with a predetermined criteria.

* * * * *